US010181643B2

(12) United States Patent
Liu

(10) Patent No.: US 10,181,643 B2
(45) Date of Patent: Jan. 15, 2019

(54) APPROACH TO IMPROVE POINTING ACCURACY OF ANTENNA SYSTEMS WITH OFFSET REFLECTOR AND FEED CONFIGURATION

(71) Applicant: THE BOEING COMPANY, Chicago, IL (US)

(72) Inventor: Yong Liu, Chicago, IL (US)

(73) Assignee: THE BOEING COMPANY, Chicago, IL (US)

( * ) Notice: Subject to any disclaimer, the term of this patent is extended or adjusted under 35 U.S.C. 154(b) by 450 days.

(21) Appl. No.: 14/639,885

(22) Filed: Mar. 5, 2015

(65) Prior Publication Data

US 2016/0261040 A1 Sep. 8, 2016

(51) Int. Cl.

| | |
|---|---|
| ***H01Q 3/08*** | (2006.01) |
| ***H01Q 1/18*** | (2006.01) |
| ***H01Q 1/34*** | (2006.01) |
| ***H01Q 19/13*** | (2006.01) |
| ***H01Q 1/28*** | (2006.01) |
| ***H01Q 1/32*** | (2006.01) |

(52) U.S. Cl.

CPC ..... *H01Q 3/08* (2013.01); *H01Q 1/288* (2013.01); *H01Q 1/32* (2013.01); *H01Q 1/34* (2013.01); *H01Q 19/132* (2013.01)

(58) Field of Classification Search

CPC ..... H01Q 3/08; H01Q 1/288; H01Q 1/32; H01Q 1/34; H01Q 19/132; H01Q 25/007; H01Q 19/175; H01Q 1/281; H01Q 1/18; H01Q 1/25; H01Q 3/30; H01Q 19/192; H01Q 1/185; H01Q 1/125; H01Q 3/02; G01S 13/68; G01S 13/72; G01S 7/4026; G01S 7/4802; G01S 3/784; G01S 3/023; G01S 13/723; G01S 1/08; G01S 19/02; F41G 7/22; F41G 7/2213; G05D 3/1454; B64G 1/24; B64G 1/36; G01C 19/00; H04B 7/18571; G01Q 3/10

USPC ..... 342/359

See application file for complete search history.

(56) References Cited

U.S. PATENT DOCUMENTS 4,145,695 A * 3/1979 Gans ..... H01O 25/007 343/779

4,148,029 A * 4/1979 Quesinberry ..... G01S 13/68 342/106

(Continued)

*Primary Examiner* — Bernarr E Gregory
*Assistant Examiner* — Nuzhat Pervin
(74) *Attorney, Agent, or Firm* — Haynes and Boone, LLP

(57) ABSTRACT

Systems, methods, and apparatus for calibration for an offset antenna are disclosed. In one or more embodiments, the disclosed method involves calculating an estimated gimbal angle between the offset antenna and at least one target. Also, the method involves transmitting, by at least one target, at least one signal; and receiving, by the offset antenna, at least one signal. The method further involves pointing the offset antenna to an optimum gimbal angle to maximize received signal power. Additionally, the method involves comparing the optimum gimbal angle with the estimated gimbal angle to determine a difference in the gimbal angles. Also, the method involves calculating a bus, reflector, and/or feed error estimate by using the difference in the gimbal angles. Further, the method involves determining an azimuth and/or elevation correction for bus, reflector, and/or feed errors by using the bus, reflector, and/or feed error estimate.

17 Claims, 12 Drawing Sheets

(56) References Cited

U.S. PATENT DOCUMENTS 4,179,696 A * 12/1979 Quesinberry ..... G01S 13/72 342/75
4,589,610 A * 5/1986 Schmidt ..... F41G 7/22 244/3.19
4,823,134 A * 4/1989 James ..... G05D 3/1454 342/359
4,911,385 A * 3/1990 Agrawal ..... B64G 1/24 244/164
5,175,562 A * 12/1992 Rappaport ..... H01Q 19/12 343/840
5,202,700 A * 4/1993 Miller ..... H01Q 19/17 343/840
5,629,705 A * 5/1997 Spettel ..... F41G 7/2213 342/62
5,793,332 A * 8/1998 Fowler ..... H01Q 1/281 343/705
5,818,393 A * 10/1998 Fowler ..... H01Q 1/281 343/705
6,020,844 A * 2/2000 Bai ..... G01S 7/4026 342/147
6,433,736 B1 * 8/2002 Timothy ..... H01Q 1/18 342/359
6,538,602 B2 * 3/2003 Natsume ..... H01Q 1/125 342/359
6,690,458 B2 * 2/2004 Schorr ..... G01S 3/784 250/206.2
6,731,240 B2 * 5/2004 Dybdal ..... G01S 3/023 342/354
6,982,678 B2 * 1/2006 Obert ..... H01Q 3/26 343/775
7,053,815 B1 * 5/2006 Joynson ..... G01S 13/723 342/101
7,154,439 B2 * 12/2006 Westall ..... G01S 1/08 342/358
7,221,316 B2 * 5/2007 O'Brien ..... B64G 1/1014 342/354
7,256,734 B2 * 8/2007 Tekawy ..... G01S 19/02 342/174
7,409,292 B2 * 8/2008 Eckert ..... H01Q 1/18 244/171
7,411,561 B1 * 8/2008 Baldauf ..... H01Q 19/192 343/761
7,437,222 B2 * 10/2008 Liu ..... G01C 19/00 701/13
7,633,432 B2 * 12/2009 Wu ..... H01Q 3/10 342/158
7,724,188 B2 * 5/2010 Liu ..... H01Q 1/185 342/359
7,999,726 B2 * 8/2011 Guertin ..... H01Q 1/125 244/3.1
8,648,748 B2 * 2/2014 Yakubovich ..... H01Q 1/125 342/359
2002/0140924 A1 * 10/2002 Wangler ..... G01S 7/4802 356/28
2003/0016172 A1 * 1/2003 Natsume ..... H01Q 1/125 342/359
2006/0065788 A1 * 3/2006 Tsao ..... B64G 1/36 244/171
2007/0046537 A1 * 3/2007 Tekawy ..... G01S 19/02 342/358
2012/0249366 A1 * 10/2012 Pozgay ..... H04B 7/18571 342/354
2016/0118715 A1 * 4/2016 Adams ..... H01Q 3/02 342/352

* cited by examiner

*Pointing LOS:*

$$^{o}e_{out} = C_{ob}\,{}^{b}e_{out} = C_{ob}\,H\left({}^{b}e_{m}\right) \qquad \textit{Equation 5}$$

$$d\left({}^{o}e_{out}\right) = \underbrace{dC_{ob}\,H\left({}^{b}e_{m}\right)}_{dp_1} + \underbrace{C_{ob}\,dH\left({}^{b}e_{m}\right)}_{dp_2} + \underbrace{C_{ob}\,Hd\left({}^{b}e_{m}\right)}_{dp_3} \qquad \textit{Equation 6}$$

$C_{ob}$ ← *body (feed) to orbit frame attitude transformation matrix (DCM)*

$$C_{bo} = (I - \widetilde{\theta}_{bo})$$

$$\widetilde{\theta}_{bo} = \text{tilde}(\theta_{bo}) \qquad \textit{Equation 7}$$

$$C_{ob} = C_{ob}' = I + \widetilde{\theta}_{bo}$$

$\theta_{bo}$ ← *body to orbit frame attitude error vector*

$dp_1 \approx dC_{ob}\left({}^{b}e_{out}\right) = \widetilde{\theta}_{bo}\left({}^{b}e_{out}\right)$ ← *body attitude errors projected to LOS direction*

*FIG. 3A*

$$dp_2 = C_{ob}\,dH\left({}^{b}e_{m}\right) \approx dH\left({}^{b}e_{m}\right) \qquad \textit{Equation 8}$$

$$dH = -2dnn' - 2ndn' \qquad \textit{Equation 9}$$

$$dn\Big|_{b} = dn\Big|_{r} + \widetilde{\theta}_{rb}\,n = \widetilde{\theta}_{rb}\,n \qquad \textit{Equation 10}$$

$\theta_{rb}$ ← *reflector orientation relative to body error (expressed in body)*

$$dH = -2\underbrace{dnn'}_{A} - 2\underbrace{ndn'}_{A'} = -2(A + A') \qquad \textit{Equation 11}$$

$$dp_2 \approx -2(A + A')\left({}^{b}e_{m}\right)$$

*FIG. 3B*

$$dp_3 \approx Hd\left({}^{b}e_m\right) = H[I-2\left({}^{b}e_m\right)\left({}^{b}e_m\right)'] \frac{dL}{\|\bar{L}\|} \qquad \textit{Equation 12}$$

$$dp \approx \underbrace{-\tilde{\theta}_{ob}\, e_{out}}_{\textit{Bus Error}} \underbrace{-2(A+A')\, e_{in}}_{\textit{Reflector Error}} \underbrace{+H(I-2e_{in}e_{in}')\frac{dL}{\|\bar{L}\|}}_{\textit{Feed to Reflector Translational Error}} \qquad \textit{Equation 13}$$

*define error components*

$$\theta_{bo} = \begin{bmatrix} \theta_{bo,\,x} \\ \theta_{bo,\,y} \\ \theta_{bo,\,z} \end{bmatrix} \theta_{rb} = \begin{bmatrix} \theta_{rb,\,x} \\ \theta_{rb,\,y} \\ \theta_{rb,\,z} \end{bmatrix} dL = \begin{bmatrix} dL_x \\ dL_y \\ dL_z \end{bmatrix} \qquad \textit{Equation 14}$$

$$\Delta \equiv \begin{bmatrix} \theta_{bo} \\ \theta_{rb} \\ dL \end{bmatrix} \in R^9 \longrightarrow dp = M\Delta \qquad \textit{Equation 15}$$

*where* $M \in R^{3x9}$ *is the Jacobian of the nonlinear relationship*

*FIG. 4*

$C_{bg_0}$ ← *gimbal frame to bus frame DCM*

*The unit vector normal to the surface antenna in bus frame with gimbal motion*

$$C_{gg_0} = dcm(2,e)dcm(1,a) \qquad \textit{Equation 16}$$

$$n = C_{bg_0}\begin{bmatrix} 0 \\ 0 \\ 1 \end{bmatrix} \leftarrow \text{original} \qquad \textit{Equation 17}$$

$$n = C_{bg_0} C_{gg_0}'(a,e)\begin{bmatrix} 0 \\ 0 \\ 1 \end{bmatrix} \leftarrow \text{gimballed} \qquad \textit{Equation 18}$$

*As reflector orientation changes with gimbal. LOS purturbation model also changes*

*Reflector error has two parts: (1) due to reflector, (2) due to bus*

$$\theta_{rb} = \theta_{rg} + \theta_{gb} \leftarrow \textit{original} \qquad \textit{Equation 19}$$

$$\theta_{rb} = (C_{gg_0})'\theta_{rg} + \theta_{gb} \leftarrow \textit{after moving the gimbal} \qquad \textit{Equation 20}$$

*FIG. 5*

*Original LOS unit vector*

$$e_{out} = \begin{bmatrix} x_0 \\ y_0 \\ z_0 \end{bmatrix} \qquad \textit{Equation 21}$$

*Perturbed LOS unit vector*

$$\frac{e_{out} + de_{out}}{\left\| e_{out} + de_{out} \right\|} = \begin{bmatrix} x \\ y \\ z \end{bmatrix} \qquad \textit{Equation 22}$$

*Errors in Az and El*

$$\Delta Az = \arctan\left(\frac{x}{z}\right) - \arctan\left(\frac{x_0}{z_0}\right) \approx \frac{x}{z} - \frac{x_0}{z_0} \approx x - x_0 \approx dp(1) \qquad \textit{Equation 23}$$

$$\Delta El = \arcsin(-y) - \arcsin(-y_0) \approx -y + y_0 \approx -dp(2) \qquad \textit{Equation 24}$$

*FIG. 6*

$$dp \approx \underbrace{-\tilde{\theta}_{ob} H(a,e)e_{in}}_{\text{Bus Error}(a,e)} \underbrace{-2[A(a,e)+A'(a,e)]e_{in}}_{\text{Reflector Error}(a,e)} \underbrace{+H(a,e)(I-2e_{in}e_{in}')\frac{dL}{\|\bar{L}\|}}_{\text{Feed to Reflector Translational Error}} \qquad \textit{Equation 25}$$

$$n=C_{bg_0}C_{gg_0}'(a,e)\begin{bmatrix}0\\0\\1\end{bmatrix}=C_{bg_0}\begin{bmatrix}\sin e\\-\cos e\sin a\\\cos a\cos e\end{bmatrix} \qquad \textit{Equation 26}$$

$$dn=[(C_{gg_0}'(a,e)\theta_{rg}+\theta_{gb})\times]C_{bg_0}\begin{bmatrix}\sin e\\\cos e\sin a\\\cos a\cos e\end{bmatrix} \qquad \textit{Equation 27}$$

$$H=I-2nn' \qquad \textit{Equation 28}$$

$$A=dnn' \qquad \textit{Equation 29}$$

*FIG. 7*

$$\theta_{ob} = \begin{bmatrix} 0 \\ 0 \\ 0 \end{bmatrix} \theta_{rg} = \begin{bmatrix} 0 \\ 0 \\ 0 \end{bmatrix}, \theta_{gb} = \begin{bmatrix} 0 \\ 0 \\ 0 \end{bmatrix}$$ *Equation 30*

$$\Downarrow$$

$$dp \approx H(I-2e_{in}e_{in}') \frac{dL}{\|\bar{L}\|}$$ *Equation 31*

$$C_{bg_0} = I$$ *Equation 32*

$$\Downarrow$$

$$n = \begin{bmatrix} \sin e \\ -\cos e \sin a \\ \cos a \cos e \end{bmatrix}$$ *Equation 33*

$$H = I-2nn' = \begin{bmatrix} \cos(2e) & \sin(a)\sin(2e) & -\sin(2e)\cos(a) \\ \sin(a)\sin(2e) & 1-2\cos^2(e)\sin^2(a) & \sin(2a)\cos^2(e) \\ -\sin(2e)\cos(a) & \sin(2a)\cos^2(e) & 1-2\cos^2(e)\cos^2(a) \end{bmatrix}$$ *Equation 34*

*FIG. 8*

$$e_{in} = \sqrt{2}\begin{pmatrix} -\sqrt{5} \\ 0 \\ -\sqrt{5} \end{pmatrix} \qquad \textit{Equation 35}$$

$$\Downarrow$$

$$I - 2e_{in}e_{in}' = \begin{bmatrix} 0 & 0 & -1 \\ 0 & 1 & 0 \\ -1 & 0 & 0 \end{bmatrix} \qquad \textit{Equation 36}$$

$$dp \approx \frac{1}{\|\bar{L}\|}\begin{bmatrix} \sin(2e)\cos(a) & \sin(a)\sin(2e) & 1-2\cos^2(e) \\ -\sin(2a)\cos^2(e) & 1-2\cos^2(e)\sin^2(a) & -\sin(a)\sin(2e) \\ 2\cos^2(a)\cos^2(e)-1 & \sin(2a)\cos^2(e) & \sin(2e)\cos(a) \end{bmatrix} dL \qquad \textit{Equation 37}$$

*FIG. 9*

FIG. 10

$$\begin{bmatrix} \Delta az_{m1} \\ \Delta el_{m1} \\ \Delta az_{m2} \\ \Delta el_{m2} \end{bmatrix} = \underbrace{\frac{1}{\|\bar{L}\|} \begin{bmatrix} \sin(2e_1)\cos(a_1) & \sin(a_1)\sin(2e_1) & 1-2\cos^2(e_1) \\ -\sin(2a_1)\cos^2(e_1) & 1-2\cos^2(e_1)\sin^2(a_1) & -\sin(a_1)\sin(2e_1) \\ \sin(2e_2)\cos(a_2) & \sin(a_2)\sin(2e_2) & 1-2\cos^2(e_2) \\ -\sin(2a_2)\cos^2(e_2) & 1-2\cos^2(e_2)\sin^2(a_2) & -\sin(a_2)\sin(2e_2) \end{bmatrix}}_{K(a_1,e_1,a_2,e_2)} \begin{bmatrix} dL_x \\ dL_y \\ dL_z \end{bmatrix}$$

*Equation 38*

$$\Downarrow$$

$$dL_{est} = (k'\,k)^{-1}(k') \begin{bmatrix} \Delta az_{m1} \\ \Delta el_{m1} \\ \Delta az_{m2} \\ \Delta el_{m2} \end{bmatrix}$$

*Equation 39*

$$\begin{bmatrix} \Delta az(a,e) \\ \Delta el(a,e) \end{bmatrix} = -H(a,e)(I-2e_{in}e_{in}')\frac{dL_{est}}{\|\bar{L}\|}$$

*Equation 40*

APPROACH TO IMPROVE POINTING ACCURACY OF ANTENNA SYSTEMS WITH OFFSET REFLECTOR AND FEED CONFIGURATION

FIELD

The present disclosure relates to an antenna calibration approach. In particular, it relates to an offset antenna calibration approach.

BACKGROUND

For antenna systems with offset reflector and feed configurations, rotational errors between the reflector and the host vehicle, and translational errors between the feed and the reflector can degrade antenna pointing accuracy. Currently, there are two main existing solutions to the pointing problems of offset antenna systems. The first solution is to use a real-time beacon tracking system for the antenna with which the total pointing errors are constantly measured and corrected for by a closed-loop beacon control loop. The drawback to this first solution is that beacon tracking systems are very expensive, and even if a beacon tracking system is included in the design, the antenna pointing performance is usually unacceptable when the beacon system is unavailable. The second solution is to design with a large margin in the antenna radio frequency (RF) performance so that the system can tolerate large pointing errors without affecting system performance. The drawback for this second solution is that this solution is also very expensive, and may not work at all for systems with tight pointing accuracy requirements.

As such, there is a need for an improved technique to correct for pointing errors of offset antenna systems

SUMMARY

The present disclosure relates to a method, system, and apparatus for an offset antenna calibration approach. In one or more embodiments, a method for calibration for an offset antenna involves determining at least one target in a known location. The method further involves calculating, with at least one processor, an estimated gimbal angle between the offset antenna and at least one target (or between the offset antenna and each of the targets). Further, the method involves transmitting, by at least one antenna of at least one target, at least one signal. Also, the method involves receiving, by the offset antenna, at least one signal. In addition, the method involves pointing the offset antenna to an optimum gimbal angle, for at least one target (or for each of the targets), to maximize received signal power of at least one signal. In addition, the method involves comparing, by at least one processor, the optimum gimbal angle with the estimated gimbal angle, for at least one target (or for each of the targets), to determine a difference in the gimbal angles for at least one target (or for each of the targets). Additionally, the method involves calculating, by at least one processor, a bus error estimate, a reflector error estimate, and/or a feed error estimate by using the difference in the gimbal angles, for at least one target (or for each of the targets). Further, the method involves determining, by at least one processor, an azimuth correction and/or an elevation correction for bus errors, reflector errors, and/or feed errors by using the bus error estimate, the reflector error estimate, and/or the feed error estimate. In one or more embodiments, the method further involves pointing the offset antenna according to the azimuth correction and/or the elevation correction for the bus errors, the reflector errors, and/or the feed errors.

In one or more embodiments, the offset antenna is mounted onto a vehicle. In at least one embodiment, the vehicle is an airborne vehicle, a terrestrial vehicle, or a marine vehicle. In some embodiments, the airborne vehicle is a satellite, an aircraft, or a space plane. In one or more embodiments, the terrestrial vehicle is a truck, a train, a car, or a tank. In some embodiments, the marine vehicle is a ship or a boat.

In at least one embodiment, at least one signal is an electromagnetic (EM) signal. In some embodiments, the EM signal is a radio frequency (RF) signal, an optical signal, or an infra-red signal.

In one or more embodiments, the offset antenna comprises at least one feed.

In some embodiments, the offset antenna comprises at least one reflector.

In at least one embodiment, at least one target is a ground station. In some embodiments, the offset antenna is mounted onto a vehicle.

In one or more embodiments, a system for calibration for an offset antenna involves at least one target in a known location, where at least one antenna of at least one target is to transmit at least one signal. The system further involves the offset antenna to receive at least one signal, and to point to an optimum gimbal angle, for at least one target (or for each of the targets), to maximize received signal power of at least one signal. In addition, the system involves at least one processor to calculate an estimated gimbal angle between the offset antenna and at least one target (or between the offset antenna and each of the targets); to compare the optimum gimbal angle with the estimated gimbal angle, for at least one target (or for each of the targets); to determine a difference in the gimbal angles for at least one target (or for each of the targets); to calculate a bus error estimate, a reflector error estimate, and/or a feed error estimate by using the difference in the gimbal angles, for at least one target (or for each of the targets); and to determine an azimuth correction and/or an elevation correction for bus errors, reflector errors, and/or feed errors by using the bus error estimate, the reflector error estimate, and/or the feed error estimate. In one or more embodiments, the system further involves the offset antenna to point according to the azimuth correction and/or the elevation correction for the bus errors, the reflector errors, and/or the feed errors.

The features, functions, and advantages can be achieved independently in various embodiments of the present disclosure or may be combined in yet other embodiments.

DRAWINGS

These and other features, aspects, and advantages of the present disclosure will become better understood with regard to the following description, appended claims, and accompanying drawings where:

FIGS. 3A and 3B show equations for the line of sight (LOS) error review for the disclosed system for an offset antenna calibration approach, in accordance with at least one embodiment of the present disclosure.

FIG. 4 shows equations for calculating the total error for the disclosed system for an offset antenna calibration approach, in accordance with at least one embodiment of the present disclosure.

FIG. 5 shows equations for calculating the gimbal motion for the disclosed system for an offset antenna calibration approach, in accordance with at least one embodiment of the present disclosure.

FIG. 6 shows equations for calculating the body azimuth/elevation (AZ/EL) errors for a beacon model for the disclosed system for an offset antenna calibration approach, in accordance with at least one embodiment of the present disclosure.

FIG. 7 shows equations for calculating the gimbal angle dependency for the disclosed system for an offset antenna calibration approach, in accordance with at least one embodiment of the present disclosure.

FIGS. 8 and 9 show equations for calculating reflector translation errors (dL) for a simple case for the disclosed system for an offset antenna calibration approach, in accordance with at least one embodiment of the present disclosure.

FIG. 10 shows equations for the estimation and correction of dL for the disclosed system for an offset antenna calibration approach, in accordance with at least one embodiment of the present disclosure.

DESCRIPTION

Figure 1A:
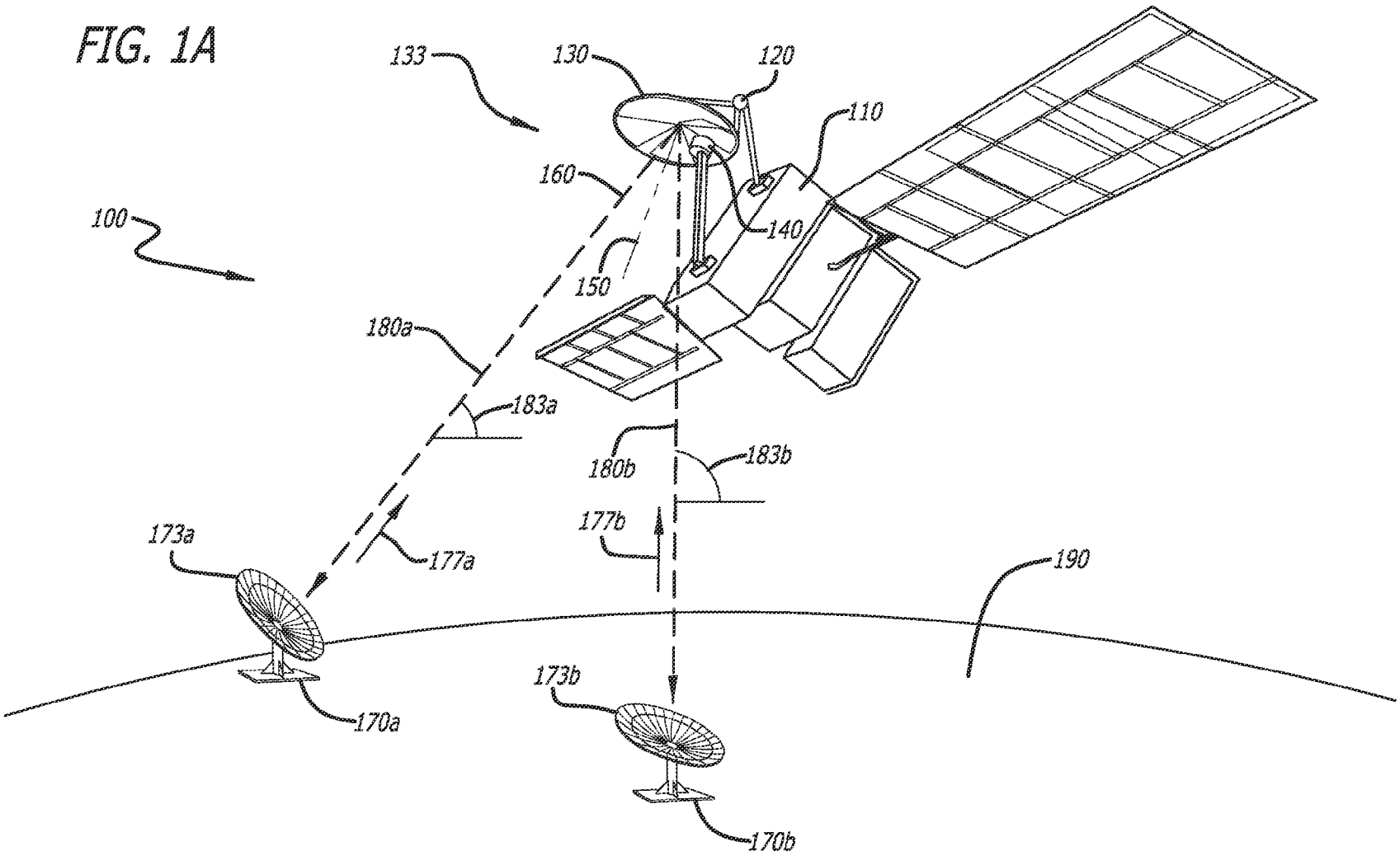
FIG. 1A is a diagram showing the disclosed system for an offset antenna calibration approach, in accordance with at least one embodiment of the present disclosure.

The methods and apparatus disclosed herein provide an operative system for an offset antenna calibration approach. The disclosed system provides approaches to estimate pointing errors (e.g., induced from both rotational errors and translational errors) for offset antenna systems, and provides corrections to those errors by ways of adjusting the reflector orientation. In particular, the disclosed system provides a way to estimate the intrinsic system errors in an offset antenna system, and provides various correction approaches based on the estimated errors.

The advantages to the disclosed system are that it allows for: (1) an offset antenna design, with an acceptable pointing performance, without a beacon tracking system, (2) an offset antenna system for multiple coverage area applications, (3) balanced beam pointing adjustment for multiple beam offset antenna systems, (4) feed-forward compensation that can supplement a beacon tracking system, (5) a non-traditional correction mechanism (e.g., a translational mechanism to move the feed instead of gimballing to move the reflector for overall pointing correction). The disclosed system can provide a basis for: (1) meeting pointing requirements for failed beacon cases, (2) ground assisted on-board antenna pointing adjustments for antenna pointing, and (3) balancing various beam pointing of a single antenna system. The disclosed system has two main benefits regarding cost savings, which are the disclosed system allows for (1) the elimination of a beacon tracking system, which is costly, in some satellite systems, and (2) maintaining certain antenna performance when a beacon tracking system fails.

It should be noted that the approach of the disclosed system is generic in nature for all different offset antenna designs. In addition, it should be noted that the disclosed system may be employed for space offset antenna applications as well as for non-space offset antenna applications.

In the following description, numerous details are set forth in order to provide a more thorough description of the system. It will be apparent, however, to one skilled in the art, that the disclosed system may be practiced without these specific details. In the other instances, well known features have not been described in detail so as not to unnecessarily obscure the system.

Embodiments of the present disclosure may be described herein in terms of functional and/or logical components and various processing steps. It should be appreciated that such components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with other components, and that the system described herein is merely one example embodiment of the present disclosure.

For the sake of brevity, conventional techniques and components related to offset antenna systems, and other functional aspects of the system (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

FIG. 1A is a diagram showing the disclosed system 100 for an offset antenna calibration approach, in accordance with at least one embodiment of the present disclosure. In this figure, a vehicle (e.g., a satellite) 100 is shown having an offset antenna 133 mounted onto its bus 110. The offset antenna 133 comprises a reflector antenna 130 with an offset feed 140. The vehicle 100 is also shown to have a gimbal 120 that can rotate (or point) the reflector 130 to reposition the antenna boresight 150, thereby rotating the line of sight (LOS) 160 of the offset antenna 133.

Also in this figure, two targets (e.g., ground stations) 170*a*, 170*b* in known locations are shown. Additionally, the gimbal angles 183*a*, 183*b* from each target 170*a*, 170*b* to the offset antenna 133 are shown.

During operation of the disclosed system, targets 170*a*, 170*b* in known locations, within the field of view of the offset antenna 133, are determined. Then, at least one processor (not shown) calculates an estimated gimbal angle between the offset antenna 133 and each target 170*a*, 170*b*. An antenna 173*a*, 173*b* of each target 170*a*, 170*b* transmits at least one signal 177*a*, 177*b*. The offset antenna 133 receives the signals 177*a*, 177*b*. A gimbal 120 gimbals (or points) the reflector 130 to an optimum gimbal angle 183*a*, 183*b*, for each target, to maximize the received signal power of the received signals 177*a*, 177*b*. It should be noted that in other embodiments, other devices or mechanisms other than a gimbal may be employed by the disclosed system 100 to point the reflector 130 to an optimum gimbal angle 183*a*, 183*b*.

At least one processor then compares the optimum gimbal angle 183*a*, 183*b* with the estimated gimbal angle, for each target, to determine a difference in the gimbal angles for each target (i.e. for each target, the difference between the estimated gimbal angle and the optimum gimbal angle is determined). Then, at least one processor calculates a bus error estimate, a reflector error estimate, and/or a feed error estimate by using the difference in the gimbal angles, for each target. At least one processor determines an azimuth correction and/or an elevation correction for bus errors, reflector errors, and/or feed errors by using the bus error estimates, the reflector error estimates, and/or the feed error estimates. Then, the gimbal 120 may gimbal (or point) the offset antenna 133 according to the azimuth correction and/or elevation correction to reposition the offset antenna 133 correctly. It should be noted that FIGS. 2 through 10 disclose the equations utilized for obtaining the bus error estimate, the reflector error estimate, and the feed error estimate as well as the azimuth correction and the elevation correction.

It should be noted that, in one or more embodiments, the vehicle 100 may be an airborne vehicle (e.g., a satellite, an aircraft, or a space plane), a terrestrial vehicle (e.g., a truck, a train, a car, or a tank), or a marine vehicle (e.g., a ship or a boat). In addition, it should be noted that the signals 177*a*, 177*b* may be an electromagnetic (EM) signal, such as a radio frequency (RF) signal, an optical signal, or an infra-red signal. Additionally, it should be noted that the offset antenna 133 may comprise more than one reflector 130 and/or more than one feed 140.

Figure 1B:
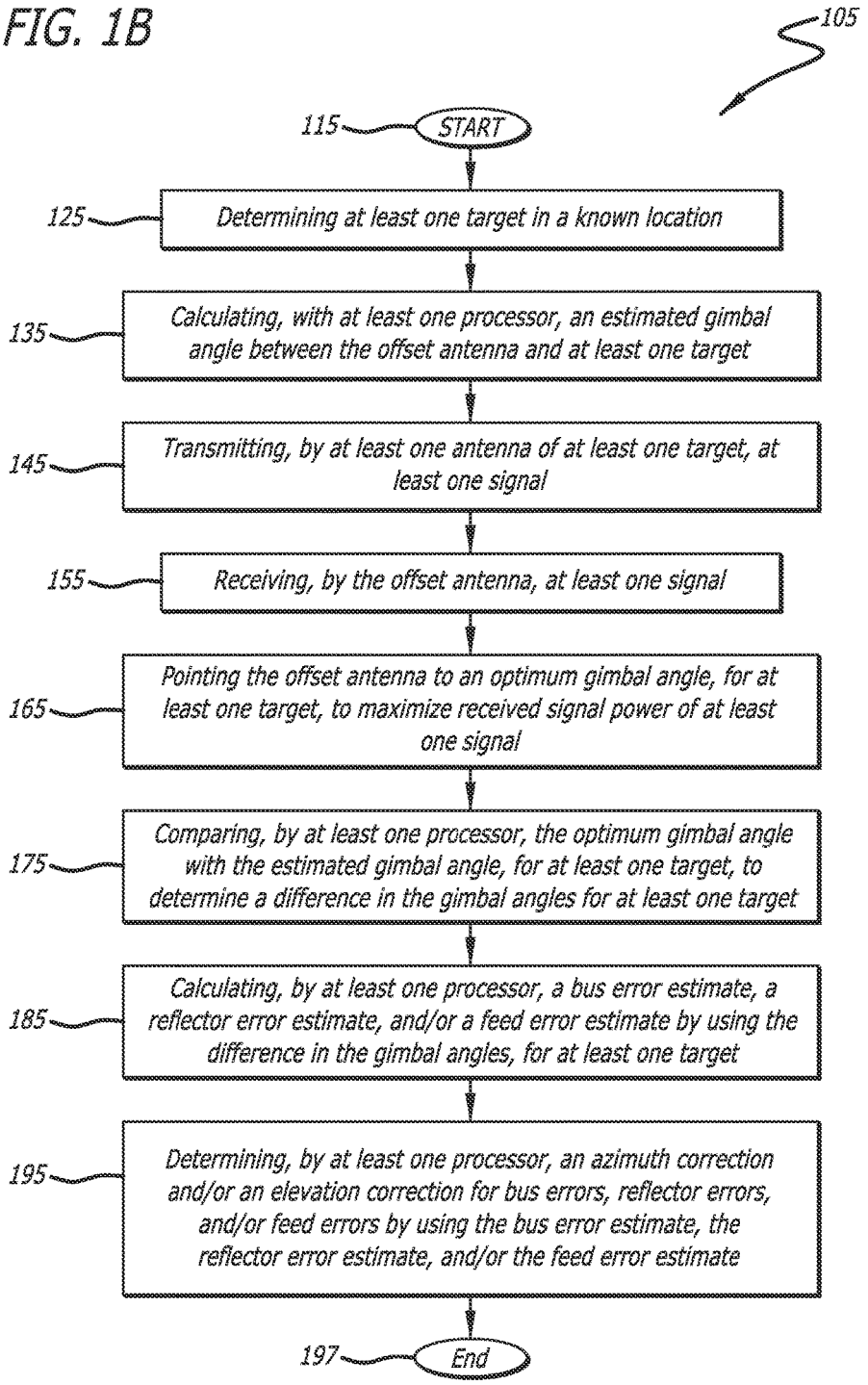
FIG. 1B depicts a flow chart depicting the disclosed method for an offset antenna calibration approach, in accordance with at least one embodiment of the present disclosure.

FIG. 1B depicts a flow chart depicting the disclosed method 105 for an offset antenna calibration approach, in accordance with at least one embodiment of the present disclosure. At the start 115 of the method 105, at least one target in a known location is determined 125. At least one processor may be used to determine the target(s) in a known location. It should be noted that at least one processor may be located on a vehicle of the offset antenna, in at least one of the targets, at an operations control center, and/or at another location.

Then, at least one processor calculates an estimated gimbal angle between the offset antenna and at least one target 135. At least one antenna of at least one target transmits at least one signal 145. Then, the offset antenna receives at least one signal 155. The offset antenna is then pointed (e.g., gimballed by a gimbal) to an optimum gimbal angle, for at least one target, to maximize the received signal power of at least one signal 165.

At least one processor then compares the optimum gimbal angle with the estimated gimbal angle, for at least one target, to determine a difference in the gimbal angles for at least one target 175. Then, at least one processor calculates a bus error estimate, a reflector error estimate, and/or a feed error estimate by using the difference in the gimbal angles, for at least one target 185. At least one processor then determines an azimuth correction and/or an elevation correction for bus errors, reflector errors, and/or feed errors by using the bus error estimate, the reflector error estimate, and/or the feed error estimate 195. In one or more embodiments, the offset antenna may then be pointed according to the azimuth correction and/or the elevation correction for the bus errors, the reflector errors, and/or the feed errors. Then, the method 115 ends 197. It should be noted that the disclosed method may utilize more than one target. The more targets that are used by the method, more intrinsic error variables can be estimated and, as such, more corrections can be made, thereby leading to an increase in accuracy.

Figure 2:
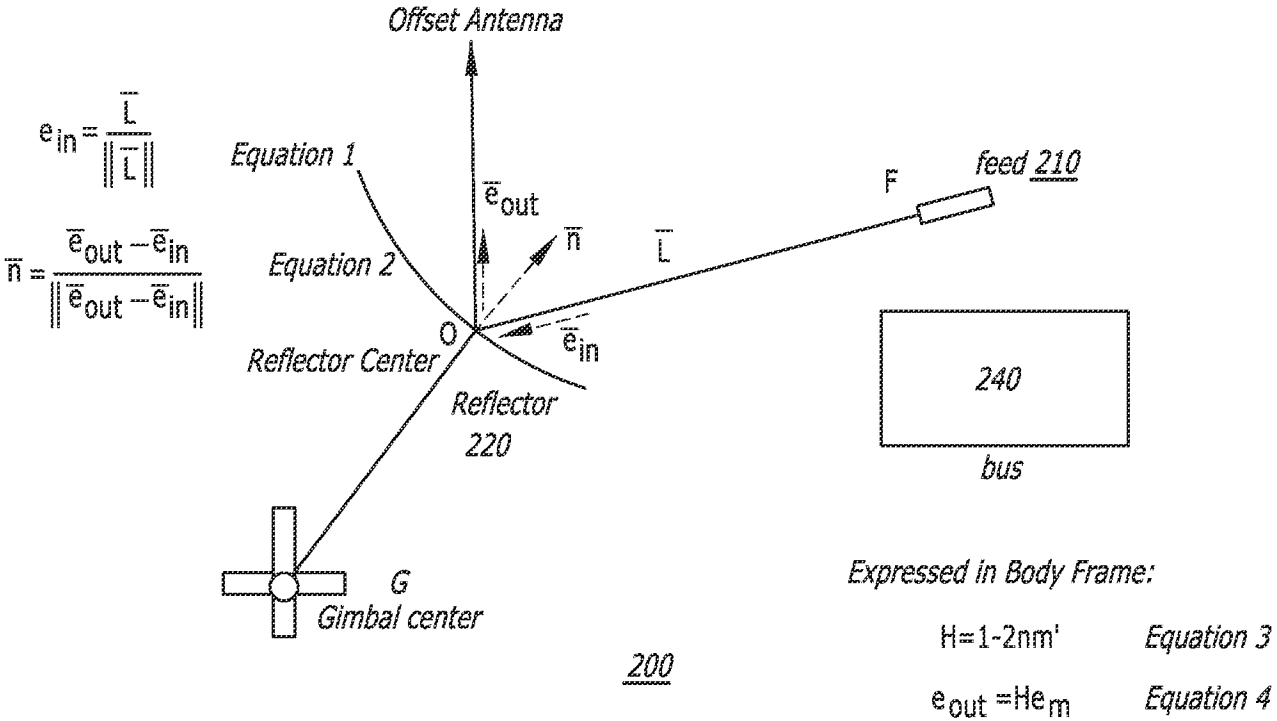
FIG. 2 is a diagram showing the geometry for the disclosed system for an offset antenna calibration approach, in accordance with at least one embodiment of the present disclosure.

FIG. 2 is a diagram 200 showing the geometry for the disclosed system for an offset antenna calibration approach, in accordance with at least one embodiment of the present disclosure. In this figure, $\vec{L}$ is the line-of-sight vector from the feed 210 to the reflector 220 center. The feed 210 is on the bus 240 and the reflector 220 is on the gimbal, which is attached to the bus 240 of the satellite.

In addition, $$\vec{e}_{in} = \frac{\vec{L}}{\|\vec{L}\|}$$

is the normalized (unit) vector of $\vec{L}$, indicating the direction only (i.e. the length is 1).

Also, $$\vec{n} = \frac{\vec{e}_{out} - \vec{e}_{in}}{\|\vec{e}_{out} - \vec{e}_{in}\|}$$

is the unit vector indicating the direction of the normal to the reflector 220 surface (i.e. the reflector 220 normal vector).

It should be noted regarding the notation of the present disclosure that, in general, $\vec{v}$ indicates a generic vector. When expressed in a particular coordinate frame, "a" (i.e. antenna coordinate frame) is written as ${}^{a}v$, with respect to its coordinates, which is a three-component column vector (3×1). Sometimes, in the present disclosure, if the coordinate frame is well understood in the context, the left-superscript will not be written.

In most cases in the present disclosure, the implied coordinate frame is the spacecraft body ("b") frame. Expressed in body frame:

$$H = I - 2nn'$$

$$e_{out} = He_{in},$$

where H is a Householder transformation matrix that maps an incoming vector to its reflected counterpart. It is a 3×3 matrix, and can be constructed using the reflector 220 normal vector.

In particular, FIG. 2 shows the geometry where the gimbal at point G rotates the antenna 220, with a boresight in then $\vec{n}$ direction (Equation 2), at point O, and rotates the attached feed 210 at point F. A signal from the feed 210 is radiated along direction $\vec{e}_{in}$ (Equation 1) towards the reflector 220 in the direction $\vec{L}$, and is reflected off the reflector 220 outward along direction $\vec{e}_{out}$. The (3×3) matrix H (Equations 3 and 4) relates the signal directions $\vec{e}_{in}$ and $\vec{e}_{out}$ in terms of the vector $\vec{n}$ and the identity matrix I. The prime (in Equation 3) indicates a vector transpose.

FIGS. 3A and 3B show equations for the line of sight (LOS) error review for the disclosed system for an offset antenna calibration approach, in accordance with at least one embodiment of the present disclosure. In general, notation $C_{ab}$ refers to the direction cosine matrix (DCM) from coordinate frame "b" (i.e. spacecraft body frame) to coordinate frame "a" (i.e. antenna frame). A generic vector $\vec{v}$ can be expressed in two different coordinate frames with its coordinate vectors in the two frames, ${}^{a}v$ and ${}^{b}v$ relating to each other by ${}^{a}v=C_{ab}{}^{b}v$.

${}^{o}e_{out}$ is the out line-of-sight unit vector as expressed in the "o" or "orbit" coordinate frame.

${}^{b}e_{out}$ is the out line-of-sight unit vector as expressed in the "b" or "body" coordinate frame.

$C_{ob}$ is the DCM from the body frame to the orbit frame.

$d({}^{o}e_{out}), dC_{ob}, dH, d({}^{b}e_{in})$ are the differentials of: (1) the outgoing LOS vector in the orbit frame, (2) the body-to-orbit DCM, (3) the Householder matrix, and (4) the incoming LOS vector in body frame, respectively.

$\tilde{\theta}_{bo}=\text{tilde}(\theta_{bo})$ is the "tilde" matrix of a vector cross product. It is a skew-symmetric matrix. If the underling vector in a frame is given by $$v = \begin{bmatrix} v_x \\ v_y \\ v_z \end{bmatrix},$$

then we have (note other notations commonly used for the "tilde" matrix):

$$\tilde{v} = \text{tilde}(v) = [v\times] = \begin{bmatrix} 0 & -v_z & v_y \\ v_z & 0 & -v_x \\ -v_y & v_x & 0 \end{bmatrix}.$$

$\theta_{bo}$ is the small angle error of the body frame relative to the orbit frame.

$\theta_{rb}$ is the small angle error of the reflector frame relative to the body frame.

$dp_1$, $dp_2$, $dp_3$ are the outgoing LOS vector differential due to body attitude error, reflector relative to body error, and incoming LOS error, respectively.

The line-of-sight output, ${}^{o}e_{out}$, in the orbit "o" frame (denoted by the superscript "o" preceding the variable) is given by Equation 5.

The line-of-sight errors $dp=d({}^{o}e_{out})=dp_1+dp_2+dp_3$ give the change in output signal LOS pointing (Equation 6). The components of dp are: $dp_1$ the body error projected to the LOS direction or bus error, due to misalignments between the body and orbit frames, $\theta_{ob}$; $dp_2$ the reflector error, due to reflector orientation relative to body error, $\theta_{rb}$; and $dp_3$ the body error feed to reflector translation errors, due feed to reflector translation errors, dL.

The superscripts to the left of the variable refer to the coordinate frame that they are in (e.g., o=orbit frame, b=satellite body frame).

The (3×3) direction cosine matrix (DCM) $C_{ob}$ relates to the body "b" to orbit "o" frames (Equation 7).

The LOS error $dp_2$, the reflector error is due to reflector orientation errors relative to the body error, $\theta_{rb}$, and is given by Equation 8 and Equation 11.

The expression for (3×3) matrix H is given by Equation 3 in FIG. 2.

The change in H, which is dH, (Equation 9) is due to changes dn, in the reflector normal vector n, given in terms of $\theta_{rb}$ in Equation 10.

The resulting change in H, which is dH, is expressed in terms of (3×3) matrix A, and its transpose A' in Equation 11.

FIG. 4 shows equations for calculating the total error for the disclosed system for an offset antenna calibration approach, in accordance with at least one embodiment of the present disclosure.

$$v = \begin{bmatrix} v_x \\ v_y \\ v_z \end{bmatrix}:$$

subscripts refer to the coordinates in the three directions of the frame.

M is the mapping (or sensitivity) matrix that maps the bus errors, the reflector errors, and the feed-to-reflector errors into the overall LOS pointing errors in three directions. It is the linear approximation ($1^{st}$ order) of the more complex nonlinear relationship.

The LOS error $dp_3$, the body error feed to reflector translation error, is due feed to reflector translation errors, dL, as indicated in Equation 12.

The combined LOS error is provided in Equation 13, which is Equation 6 in FIG. 3A rewritten.

The error contributors to be considered in the analysis, are given in Equation 14 and combined in Equation 15.

FIG. 5 shows equations for calculating the gimbal motion for the disclosed system for an offset antenna calibration approach, in accordance with at least one embodiment of the present disclosure. $g_0$ is the nominal gimbal frame (when the two gimbal angles are zero).

g is the gimbal frame that is rotated with two gimbal angles.

An elevation over azimuth gimbal configuration is assumed, and the axis-1 is the azimuth and axis-2 is the elevation axis. In other embodiments, there is an azimuth over elevation gimbal configuration, and axis-1 is elevation and axis-2 is azimuth.

dcm(i,c) is the DCM from a first coordinate frame to a second coordinate frame by rotating in a single axis "i" of the first frame by angle "c".

a,e are the gimbal azimuth and elevation angles, respectively.

$$dcm(2, e) = \begin{bmatrix} \cos e & 0 & -\sin e \\ 0 & 1 & 0 \\ \sin e & 0 & \cos e \end{bmatrix}$$

$$dcm(1, a) = \begin{bmatrix} 1 & 0 & 0 \\ 0 & \cos a & \sin a \\ 0 & -\sin a & \cos a \end{bmatrix}$$

The LOS error $dp_2$, the reflector error, is due to reflector orientation errors relative to body error, $\theta_{rb}$.

The gimbal rotates the reflector and the attached feed.

The reflector error has two parts: (1) an error due to misalignments between the bus and the gimbal base, $\theta_{bg_0}$, and (2) the other error due to misalignments, $\theta_{rg}$, between the gimbal and reflector (Equations 19 and 20).

The gimbal angles, elevation (e) and azimuth (a), reorient the gimbal and reflector from the zero gimbal orientation, $g_0$. The (3×3) DCM matrix $C_{gg_0}$ (Equation 16) represents this reorientation.

dcm(2,e) and dcm(1,a) are each (3×3) matrices denoting a y-axis rotation through angle e and an x-axis reorientation through angle a (Equation 16).

The boresight direction, n, is along the z-axis of the gimbal frame at zero elevation and azimuth (Equations 17 and 18).

FIG. 6 shows equations for calculating the body azimuth/elevation (AZ/EL) errors for a beacon model for the disclosed system for an offset antenna calibration approach, in accordance with at least one embodiment of the present disclosure. ΔAz,ΔEl are the LOS pointing errors in the azimuth direction and elevation direction, respectively, of the body frame.

In particular, FIG. 6 shows the relationship between LOS errors, dp, (Equations 21 and 22), and the resultant changes in gimbal angles, ΔAlz,ΔEl (Equations 23 and 24.)

The azimuth changes, ΔAz, are primarily due to the x-component of the LOS error, dp(1) (Equation 23).

The elevation changes, ΔEl, primarily are due to the negative y-component of the LOS error, −dp(2) (Equation 24).

FIG. 7 shows equations for calculating the gimbal angle dependency for the disclosed system for an offset antenna calibration approach, in accordance with at least one embodiment of the present disclosure. $[(C_{gg_0}'(a,e)\theta_{rg}+\theta_{gb})x]$ is the "tilde" matrix of the vector $C_{gg_0}'(a,e)\theta_{rg}+\theta_{gb}$.

In particular, FIG. 7 shows the overall relationship between the LOS errors, dP, and the contributors: the bus error, the reflector error, and the feed to reflector translational error (Equation 25).

The boresight direction, n, is expressed in the body, b, frame (Equation 26) to express changes due to gimbal errors, dn. (Equation 27). These then introduce changes in (3×3) matrix H (Equation 28), where (3×3) matrix A in Equation 25 is given in Equation 29.

FIGS. 8 and 9 show equations for calculating dL for a simple case for the disclosed system for an offset antenna calibration approach, in accordance with at least one embodiment of the present disclosure. For this simple example calculation of dL, all errors except the error associated with the geometry between the feed and the reflector are assumed to be zero. In addition, the gimbal axes are assumed to be aligned with the body frame.

To illustrate how the bus error, $\theta_{ob}$, the reflector error, $\theta_{rb}$; and, the feed to reflector translation errors; dL can be estimated and compensated for by measuring the location of known targets and only reflector translation errors, dL, will be assumed.

The misalignments between the orbit and body frames $\theta_{ob}$; the reflector and gimbal frame $\theta_{rg}$; and the gimbal and body frame $\theta_{gb}$ are assumed to be zero (Equation 30). The LOS errors, dp, are only due to feed to reflector translation errors, dL (Equation 31). The body and zero gimbal angle frames are aligned (Equation 32). The boresight direction, n, is rotated by azimuth and elevation angles a and e, respectively (Equation 33), thereby giving the (3×3) H matrix (Equation 34). A feed orientation is assumed by specifying $e_{in}$ (Equation 35). Substituting this expression into Equation 31 in FIG. 8 and the result into Equation 13 in FIG. 4 gives the LOS error, dp, as a function of the feed to reflector translation errors, dL (Equation 37).

FIG. 10 shows equations for the estimation and correction of dL for the disclosed system for an offset antenna calibration approach, in accordance with at least one embodiment of the present disclosure. $\Delta az_{m1}$,$\Delta el_{m1}$,$\Delta az_{m2}$,$\Delta el_{m2}$, are the measured azimuth and elevation errors when pointing to a first ground station (ground station 1) and to a second ground station (ground station 2).

The relationship between the gimbal angle changes, ΔAz, ΔEl, due to LOS errors developed in FIG. 4 (Equations 14 and 15) and the correspondence between the LOS errors, dp, and the feed to reflector translation errors, dL, derived in FIG. 7 (Equation 27) can be combined to give the gimbal angle differences $\Delta az_{m1}$, $\Delta el_{m1}$, $\Delta az_{m2}$, $\Delta el_{m2}$, from the expected values $(a_1,e_1,a_2,e_2)$ due to the errors dL (Equation 38) when looking at two known targets (e.g., a first ground station and a second ground station) with expected gimbal angles $(a_1, e_1, a_2, e_2)$. These gimbal angle differences then can be used to estimate the reflector translation errors, $dL_{est}$, using a pseudo inverse (Equation 39). These error estimates, $dL_{est}$, then can be compensated for by altering the gimbal angles when pointing in another direction, a,e, as indicated by Δaz(a,e), Δel(a,e)). (Equation 40). This methodology can be applied to estimate the bus error, $\theta_{ob}$; the reflector error, $\theta_{rb}$; and the feed to reflector translation errors, dL, by measuring the location of known targets. These errors can then be compensated for by altering the gimbal angles when pointing to unknown locations.

Figure 11:
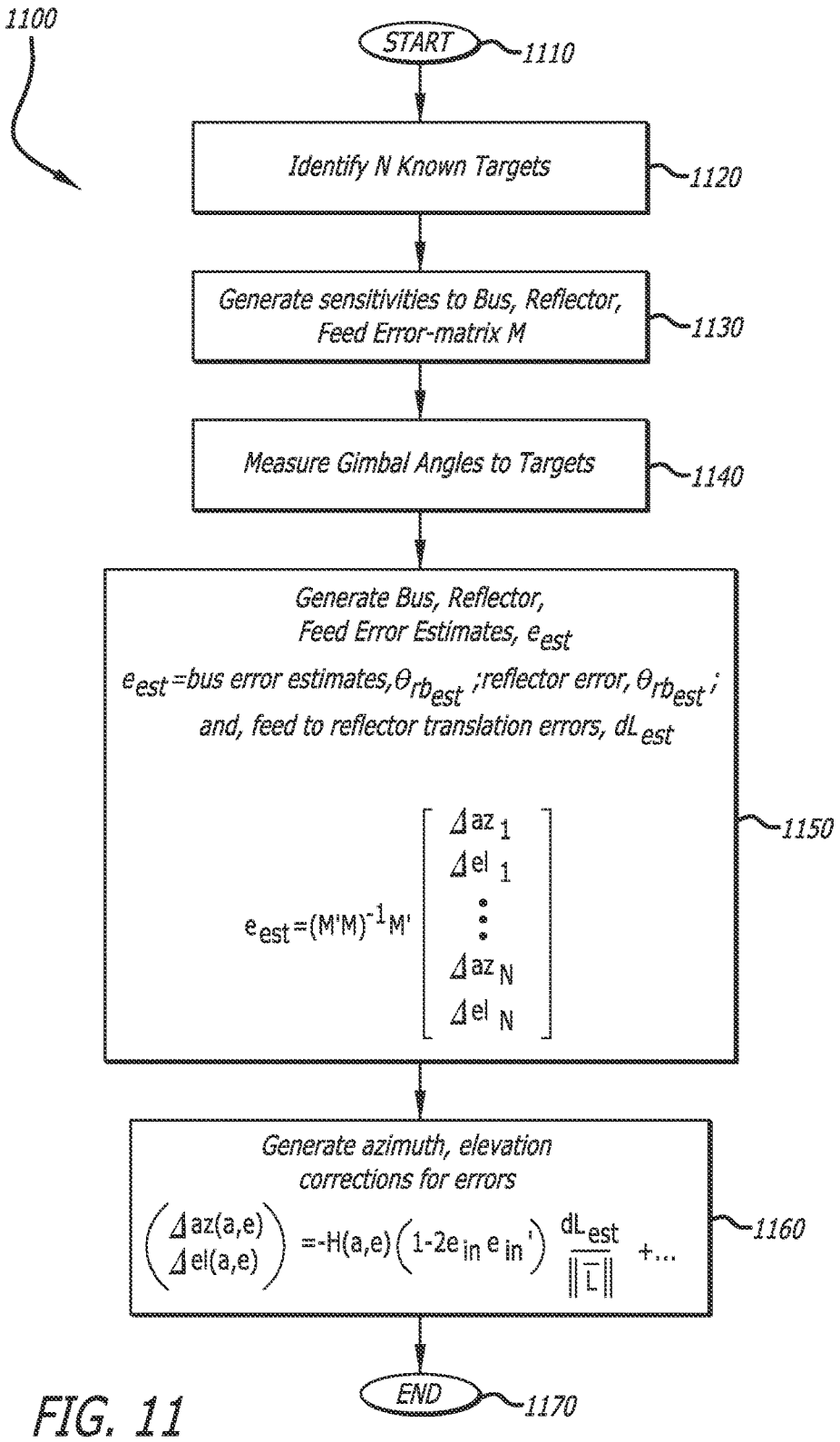
FIG. 11 depicts a flow chart depicting the disclosed method for an offset antenna calibration approach employing equation variables, in accordance with at least one embodiment of the present disclosure.

FIG. 11 depicts a flow chart depicting the disclosed method 1100 for an offset antenna calibration approach employing equation variables, in accordance with at least one embodiment of the present disclosure. At the start 1110 of the method 1100, N number of targets with known locations are identified 1120, and then the sensitivities of the LOS to these errors are calculated (matrix M) 1130. The gimbal angles to the N targets are measured 1140, and then the differences in the expected and actual measurements $\Delta az_1$,$\Delta el_1$, . . . $\Delta az_N$,$\Delta el_N$, are used to generate the system error estimates, $e_{est}$ 1150. These system error estimates are then used to generate gimbal angle corrections Δaz(a,e),Δel(a,e) for pointing corrections to known targets at gimbal angles a,e 1160. Then, the method 1100 ends 1170.

Although particular embodiments have been shown and described, it should be understood that the above discussion is not intended to limit the scope of these embodiments. While embodiments and variations of the many aspects of the present disclosure have been disclosed and described herein, such disclosure is provided for purposes of explanation and illustration only. Thus, various changes and modifications may be made without departing from the scope of the claims.

Where methods described above indicate certain events occurring in certain order, those of ordinary skill in the art having the benefit of this disclosure would recognize that the ordering may be modified and that such modifications are in accordance with the variations of the present disclosure. Additionally, parts of methods may be performed concurrently in a parallel process when possible, as well as performed sequentially. In addition, more parts or less part of the methods may be performed.

Accordingly, embodiments are intended to exemplify alternatives, modifications, and equivalents that may fall within the scope of the claims.

Although certain illustrative embodiments and methods have been disclosed herein, it can be apparent from the foregoing disclosure to those skilled in the art that variations and modifications of such embodiments and methods can be made without departing from the true spirit and scope of the art disclosed. Many other examples of the art disclosed exist, each differing from others in matters of detail only. Accordingly, it is intended that the art disclosed shall be limited only to the extent required by the appended claims and the rules and principles of applicable law.

I claim:

1. A method for calibration for an offset antenna, the method comprising:

determining at least one target in a known location;

calculating, with at least one processor, an estimated gimbal angle between the offset antenna and at least one of the targets;

transmitting, by at least one antenna of at least one of the targets, at least one signal;

receiving, by the offset antenna, the at least one signal, wherein the offset antenna is mounted onto a vehicle;

pointing the offset antenna to an optimum gimbal angle, for at least one of the targets, to maximize received signal power of the at least one signal;

comparing, by the at least one processor, the optimum gimbal angle with the estimated gimbal angle, for at least one of the targets, to determine a difference in the gimbal angles for at least one of the targets;

calculating, by the at least one processor, a bus error estimate, a reflector error estimate, and a feed error estimate by using the difference in the gimbal angles, for at least one of the targets; and determining, by the at least one processor, at least one of an azimuth correction and an elevation correction for gimballing a reflector of the offset antenna to correct for rotational errors between the reflector and the vehicle and to correct for translational errors between a feed of the offset antenna and the reflector by using the bus error estimate, the reflector error estimate, and the feed error estimate.

2. The method of claim 1, wherein the vehicle is one of an airborne vehicle, a terrestrial vehicle, and a marine vehicle.

3. The method of claim 2, wherein the airborne vehicle is one of a satellite, an aircraft, and a space plane.

4. The method of claim 2, wherein the terrestrial vehicle is one of a truck, a train, a car, and a tank.

5. The method of claim 2, wherein the marine vehicle is one of a ship and a boat.

6. The method of claim 1, wherein the at least one signal is an electromagnetic (EM) signal.

7. The method of claim 6, wherein the EM signal is one of a radio frequency (RF) signal, an optical signal, and an infra-red signal.

8. The method of claim 1, wherein at least one of the targets is a ground station.

9. A system for calibration for an offset antenna, the system comprising:

at least one target in a known location, wherein at least one antenna of at least one of the targets is to transmit at least one signal;

the offset antenna to receive the at least one signal, and to point to an optimum gimbal angle, for at least one of the targets, to maximize received signal power of the at least one signal, wherein the offset antenna is mounted onto a vehicle; and at least one processor to calculate an estimated gimbal angle between the offset antenna and at least one of the targets; to compare the optimum gimbal angle with the estimated gimbal angle, for at least one of the targets; to determine a difference in the gimbal angles for at least one of the targets; to calculate a bus error estimate, a reflector error estimate, and a feed error estimate by using the difference in the gimbal angles, for at least one of the targets; and to determine at least one of an azimuth correction and an elevation correction for gimballing a reflector of the offset antenna to correct for rotational errors between the reflector and the vehicle and to correct for translational errors between a feed of the offset antenna and the reflector by using the bus error estimate, the reflector error estimate, and the feed error estimate.

10. The system of claim 9, wherein the vehicle is one of an airborne vehicle, a terrestrial vehicle, and a marine vehicle.

11. The system of claim 10, wherein the airborne vehicle is one of a satellite, an aircraft, and a space plane.

12. The system of claim 10, wherein the terrestrial vehicle is one of a truck, a train, a car, and a tank.

13. The system of claim 10, wherein the marine vehicle is one of a ship and a boat.

14. The system of claim 9, wherein the at least one signal is an electromagnetic (EM) signal.

15. The system of claim 14, wherein the EM signal is one of a radio frequency (RF) signal, an optical signal, and an infra-red signal.

16. The method of claim 1, wherein the method further comprises gimballing, with a gimbal, the reflector of the offset antenna according to at least one of the azimuth correction or the elevation correction.

17. The system of claim 9, wherein the system further comprises a gimbal to gimbal the reflector of the offset antenna according to at least one of the azimuth correction or the elevation correction.

* * * * *